United States Patent [19]

Ozbey

[11] 4,325,379

[45] Apr. 20, 1982

[54] DERRIERE EXERCISER

[76] Inventor: Ahmet M. Ozbey, 3010 Mount Pleasant St. NW., Washington, D.C. 20009

[21] Appl. No.: 217,432

[22] Filed: Dec. 17, 1980

[51] Int. Cl.[3] ..... A41C 1/00

[52] U.S. Cl. ..... 128/540; 128/531; 128/528; 128/546

[58] Field of Search ..... 128/540, 548, 528, 524, 128/546, 579 R, 572, 531, 523, 549

[56] References Cited

U.S. PATENT DOCUMENTS

| | | | |
|---|---|---|---|
| 285,545 | 9/1883 | Bailey | 128/546 |
| 1,936,336 | 11/1933 | Montmarquet | 128/528 |
| 2,522,510 | 9/1950 | Fridolph | 128/540 |
| 4,059,117 | 11/1977 | Rosenfeld | 128/531 |

*Primary Examiner*—Doris L. Troutman

*Attorney, Agent, or Firm*—Sixbey, Friedman & Leedom

[57] ABSTRACT

An exercise garment which allows the wearer unconsciously to exercise and tone the muscles of the buttocks and pelvic floor in an isometric manner is provided. The preferred embodiment resembles a panty-type girdle and includes in the back section thereof a centrally placed longitudinal strip which separates the buttocks sections and to which is attached panels conforming to the shape of the wearer's buttocks which exert a lifting force on the buttocks in a direction substantially parallel to a line drawn from the coccyx to the iliac crest. The action of these structures causes the buttocks muscles to occupy an unnatural position, further causing them to tend to assume their natural position, and results in the isometric exercising of the superficial and deep buttocks muscles as well as those of the pelvic floor while the wearer is unconscious of the exercise of these muscles.

12 Claims, 6 Drawing Figures

DERRIERE EXERCISER

DESCRIPTION

1. Technical Field

The present invention relates generally to garments worn for purposes of exercising selected groups of muscles and, specifically, to an exercise garment including in the back section obliquely oriented panels separated by a central longitudinal strip for isometrically exercising the exterior and interior muscles of the buttocks and the muscles of the pelvic floor.

2. Background Art

The girdle-like garments known in the prior art are designed primarily to provide support for the wearer's abdomen, back or buttocks and do not contribute toward improving the tone of the muscles of these structures. Often such garments are necessary when poor muscle tone has resulted in a pendulous abdomen, flabby buttocks or back problems. Illustrative garments employed for these purposes are disclosed in U.S. Pat. Nos. 521,814; 3,396,730 and 3,524,449. The prior art garments provide combinations of elastic and nonelastic pieces so that the wearer achieves an appearance of having good muscle tone. However, the known garments have no effect on the wearer's actual muscle tone. In fact, no girdle-like garment is known which isometrically exercises the wearer's muscles and thus improves muscle tone while the garment is being worn. In the past it has been necessary for a person desiring to improve his or her muscle tone in the buttocks or pelvic floor area to consciously perform a series of exercises for this purpose. In particular, women who have experienced several pregnancies are susceptible to poor pelvic floor muscle tone and must concentrate on exercising these muscles to avoid such complications of poor muscle tone as prolapse of the uterus or bladder.

DISCLOSURE OF THE INVENTION

It is, therefore, a primary object of the present invention to overcome the disadvantages of the prior art and to provide a garment which actively improves the tone of the wearer's buttocks and pelvic floor muscles while the garment is being worn.

It is an additional object of the present invention to provide an exercise garment including a central longitudinal back strip to which is attached opposed obliquely oriented adjustable panels conforming to the shape of the buttocks for exerting a force on the wearer's buttocks causing them to be separated and pulled apart in the longitudinal direction of the panels, resulting in the contraction of the buttocks muscles to assume their customary positions.

It is yet another object of the present invention to provide a garment which allows the wearer to unconsciously engage in isometric exercises of the buttocks and pelvic floor muscles while the garment is being worn.

Further objects of the invention will become apparent from the following description and claims and from the accompanying drawings.

In accordance with the aforesaid objects a girdle-like garment is provided having a front section and a back section covering the area of the wearer's body between the waist and the upper thigh. The back section includes a central longitudinal strip to which is connected a pair of opposed obliquely oriented panels conforming to the shape of the fullest section of the buttocks and extending from the center of the buttocks around the back hips to the front section of the garment. Adjustable fasteners permit tightening of the panels as needed. Each of the panels exerts a force on a buttocks section extending substantially parallel to a line drawn from the coccyx to the right or left iliac crest. The arrangement of the center back strip and the oblique panels results in the buttocks being pulled apart and away from the center along the longitudinal direction of the panels, contrary to the natural position of these structures. This causes the buttocks muscles to contract to assume their customary positions, and the tension thus created has the effect of isometrically exercising and toning the muscles of the buttocks and the pelvic floor.

BEST MODE FOR CARRYING OUT THE INVENTION

The exercise garment of the present invention is an integrally constructed garment resembling a panty-type girdle. While the novel garment is worn it allows the wearer unconsciously to exercise the muscles of the buttocks and the pelvic floor, thus improving the tone of these muscles. The present exercise garment is intended for use by wearers of either sex who are required for medical or aesthetic reasons to improve the tone and condition of the pelvic floor and buttocks muscles. However, the present garment is particularly helpful for women whose pelvic floor muscles have been stretched by pregnancy. Formerly, exercises of these muscles had to be performed consciously to prevent the occurrence of such conditions as a prolapsed uterus or bladder. Application of the present exercise garment enables the wearer to prevent these conditions and others caused by weak pelvic floor muscles without the need for actively exercising the pelvic floor muscles. In addition, the garment may be employed by wearers of either sex to unconsciously firm and tone the muscles of the buttocks.

Figure 1:
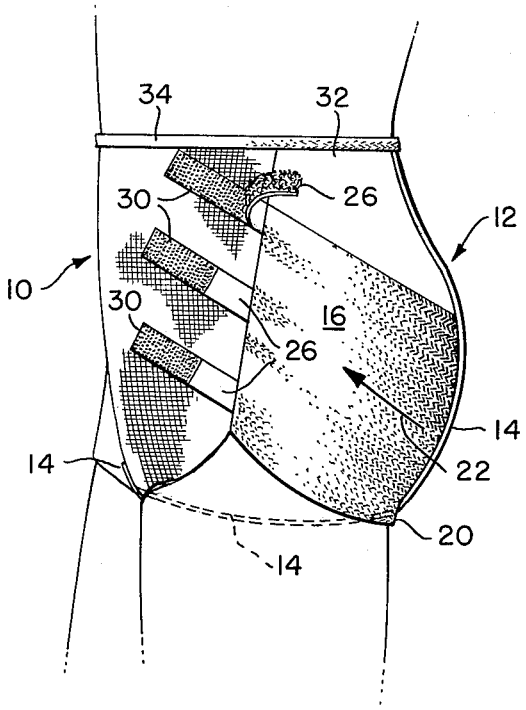
FIG. 1 is a side view of the exercise garment of the present invention of the wearer.

Referring to the drawings, FIG. 1 illustrates the garment of the present invention in side view as it appears on the wearer's body. Although the garment shown herein is constructed for a female wearer, the construction of the garment may be readily adapted for use by a male wearer. The garment generally resembles a conventional panty girdle in that it extends from the wearer's waist to approximately the tops of the thighs and includes a front section 10 joined to a back section 12 at the sides. Front section 10 is shaped like the front of a conventional pair of shorts or panties. Back section 12 includes the structural features which allow the wearer to engage unconsciously in isometric exercises of the buttocks and pelvic floor muscles while the garment is being worn.

Figure 2:
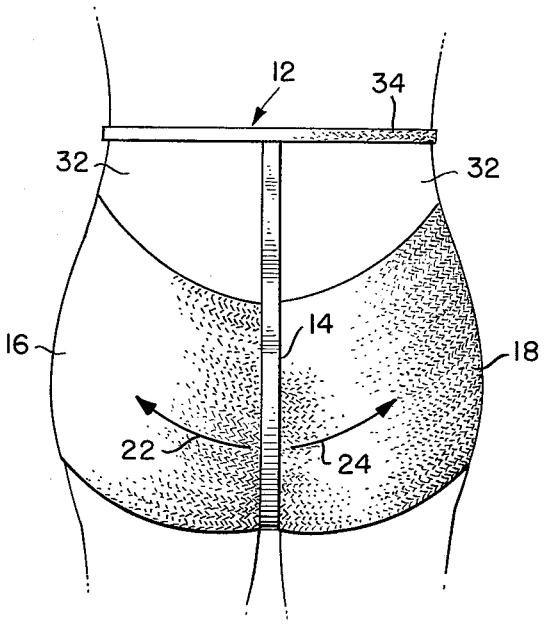
FIG. 2 is a back view of the exercise garment of the present invention on the wearer.
Figure 3:
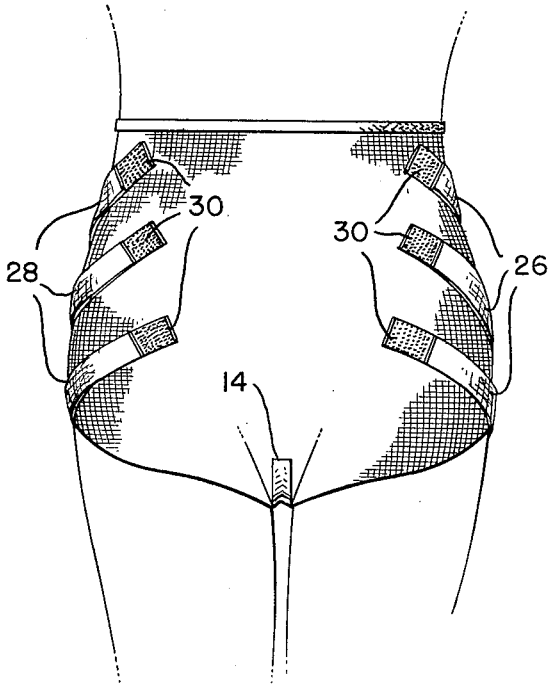
FIG. 3 is a front view of the exercise garment of the present invention on the wearer.

FIGS. 1 and 2 together illustrate this unique structure. Back section 12 includes a central longitudinal strip 14 extending from approximately the waist down the center of the lower back between the buttocks halves and between the legs around to the front, where it is attached to front section 10, as shown in FIG. 3. Panels 16 and 18 are joined to strip 14 and are shaped to conform to the shape of the buttocks, fitting snugly around the lower portion thereof ending at approximately the folds of the buttocks, as shown in side view at 20 in FIG. 1. Panels 16 and 18 are obliquely oriented to exert an upward and outward force parallel to substantially diagonal lines drawn between the coccyx and each opposed iliac crest. Panel 16 pulls the left half of the buttocks upward and outward in the direction of arrow 22, and panel 18 pulls the right half of the buttocks upward and outward in the direction of arrow 24, thus forcing the halves of the buttocks apart in opposite directions. The effect of the forces exerted by the panels 16 and 18 is to place the buttocks muscles in an unnatural position. These muscles will then tend to move toward each other and assume their customary positions against the pull of panels 16 and 18, resulting in the strengthening of the buttocks muscles as well as the underlying pelvic floor muscles in an isometric manner.

Central back strip 14 and panels 16 and 18 may be constructed of any combination of elastic and nonelastic or resilient and nonresilient material desired. An exemplary construction utilizes a nonelastic strip 14 and elastic panels 16 and 18. In the event strip 14 is a nonelastic material and panels 16 and 18 are elastic, front section 10 will most advantageously be constructed of an inelastic material to provide a stable structure for the attachment of elastic panels 16 and 18 so that these panels can effectively pull the sections of the buttocks in the desired directions. It is also possible to construct strip 14 of an elastic material and panels 16 and 18 of a nonelastic material. Front section 10 would then be constructed of an elastic material to provied some flexibility of the garment so that the buttocks sections would be able to assume their natural positions.

Panels 16 and 18 further include tabs 26 and 28, respectively, to permit adjustment of the panels as they are fastened to front section 10. As shown in FIGS. 1 through 3, these tabs fasten to corresponding Velcro strips 30 to allow maximum adjustment of panels 16 and 18. It is also contemplated to be within the scope of the present invention to provide equivalent adjustment means, such as belts and buckles, hooks and eyes or snaps.

The back section 12 of the present exercise garment may further include a yoke portion 32, which extends between panels 16 and 18 and the wearer's waist. Yoke 30 may be constructed of either a stretch, elastic material or a nonstretch, nonelastic material. However, it should preferably be less elastic than panels 16 and 18 if they are constructed of elastic material.

The present garment, as illustrated herein, is shown provided with a waistband 34, which may be of any suitable material and construction known to those skilled in the art. The function of waistband 34 is to conform the top of the garment securely and comfortably to the wearer's waist, which function may be achieved by a number of methods routinely applied by those skilled in the art.

Figure 4:
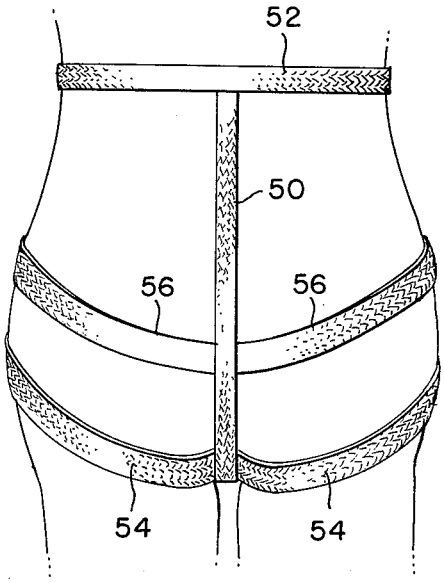
FIG. 4 is a back view of a second embodiment of the present invention.
Figure 5:
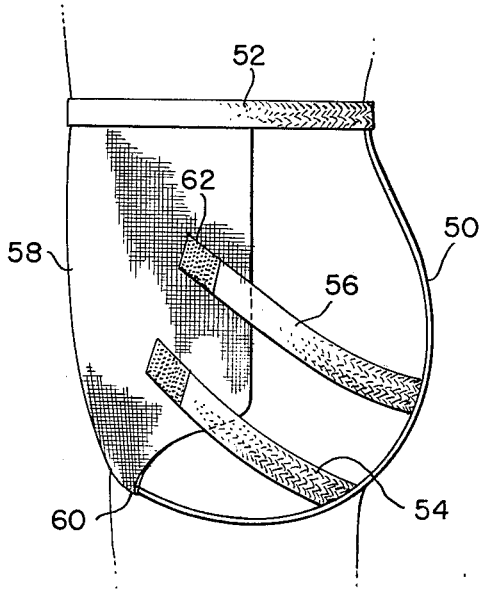
FIG. 5 is a side view of the embodiment shown in FIG. 4.

FIGS. 4 and 5 illustrate a second embodiment of the exercise garment of the present invention. In this embodiment the back section includes a central longitudinal strip 50, corresponding to strip 14 in FIGS. 1–3, which extends from a waistband 52 down the wearer's center back, between the sections of the buttocks and between the wearer's legs. The back section additionally includes two sets of opposed paired straps 54 and 56 connected to central strip 50 which perform the same function as panels 16 and 18 in FIGS. 1–3. Bottom straps 54 fit under the folds of the buttocks to lift and separate the bottom portions of these structures. Top straps 56 are positioned at approximately the fullest area of the buttocks. The force exerted by these straps is in the same direction and equivalent to that exerted by panels 16 and 18 in the embodiment of FIGS. 1–3. This embodiment further includes a solid front panel 58 which provides a relatively stable structure for attaching strip 50 and straps 54 and 56 of the back section of the garment. Strip 50 and straps 54 and 56 would, in this embodiment, most likely be constructed of elastic material, such as that conventionally used in the construction of athletic supporters and the like. Front panel 58 would then be constructed of a sturdier, nonelastic material. Other combinations of elastic and nonelastic material may also be used for the construction of strip 50 and straps 54 and 56. For example, strip 50 could be formed from an elastic material with straps 54 and 56 made of non-elastic material. Front section 58 should then preferably be constructed of an elastic, stretch material to provide needed flexibility and to permit the desired isometric exercise of the buttocks muscles. Waistband 52 is typically constructed of a stretch material which will allow the waistband to conform to the shape of the wearer's waist. Strip 50 is secured to front panel 58 in the crotch area at 60. Straps 54 and 56 are fastened to front panel 58 at the side front by adjustable Velcro fasteners 62, such as those shown in FIG. 5 and discussed hereinabove, or by any other suitable fastening means, such as buckles, snaps or the like.

Figure 6:
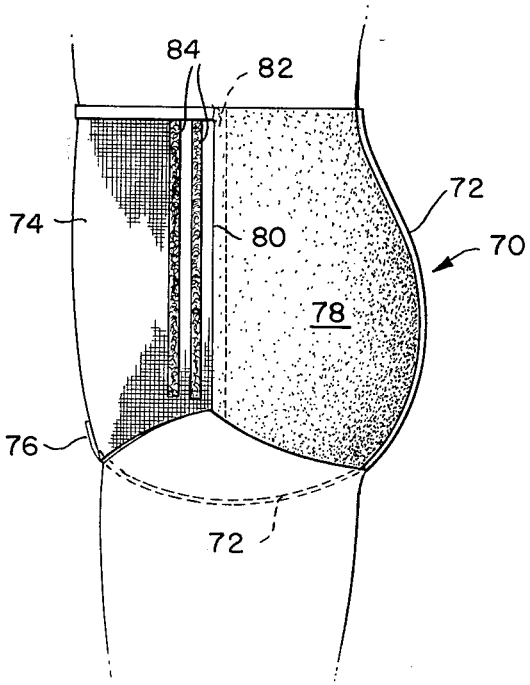
FIG. 6 is a side view of a third embodiment of the present invention.

A third embodiment, illustrated in FIG. 6, utilizes a slightly different construction and materials than previously described to achieve the same results. This embodiment of the present invention more closely resembles a panty-type girdle than the garments heretofore described. The back section 70 includes central longitudinal strip 72 corresponding to strips 14 and 50 described above and extends from the center back of the wearer's waist between the buttocks sections, between the wearer's legs and is secured to the front section 74 of the garment at 76. To central strip 72 is attached a pair of panels 78, only one of which is visible in FIG. 6, which extend from the wearer's waist to the fold of the buttocks, conforming to the contours of the wearer's buttocks. Panels 78 are preferably formed of a heavy elastic or latex material which tends to hold its shape, such as that used for heavy girdles. Side 80 of panel 78, shown in FIG. 6 includes a strip of Velcro 82 along its length which may be adjustably fastened to corresponding Velcro strips 84. Other suitable like fastening means, such as strips of snaps or hooks and eyes could also be employed to secure back panels 78 to front section 74. Front section 74 resembles the front sections 10 and 58 of the other embodiments disclosed herein. If panels 78 are formed of a heavy elastic latex type material, central strip 72 should be a nonelastic material to enhance the separation and lifting functions of the back section of the garment. Front section 74 should then be made of a sturdy inelastic material to provide the needed stability for securing back panels 78 to front section 74. Alternatively, central strip 72 could be formed of an elastic material and back panels 78 of an inelastic material. Front section 74 should then be constructed of an elastic material for the reasons discussed hereinabove. An optional elastic strip 86 may be added to provide a more secure fit for the garment around the wearer's waist. Other variations in the construction of the exercise garment disclosed herein are contemplated to be within the scope of the present invention.

Additional aspects, objects and advantages of this invention can be obtained from a study of the drawings, the disclosure and the appended claims.

I claim:

1. Apparatus for exercising the muscles of the wearer's buttocks and pelvic floor including a front section and an adjustable back section, both of said sections extending from approximately the wearer's waist to approximately the top of the wearer's thighs, said apparatus comprising:

(a) buttocks separating means for moving the sections of the buttocks away from each other;

(b) buttocks lifting means for exerting a lifting force on each buttocks section substantially parallel to a line drawn from the wearer's coccyx to the iliac crest; and (c) fastening means for adjustably securing said buttocks lifting means to the front section of said apparatus.

2. Apparatus as described in claim 1, wherein said buttocks separating means comprises a central longitudinal strip extending along the center back of said apparatus from approximately the wearer's waist in between the buttocks sections and the wearer's legs to the front section of said apparatus.

3. Apparatus as described in claim 2, wherein said buttocks lifting means comprises a pair of obliquely oriented opposed panels extending from the folds of the buttocks to approximately a line between the coccyx and each iliac crest, said panels conforming to the shape of the wearer's buttocks, said panels being securely attached at one end to said buttocks separating means and adjustably fastened at the other end to the front of said apparatus.

4. Apparatus as described in claim 3, wherein the back section of said apparatus further includes a yoke portion attached to said buttocks lifting means which extends the back section of said apparatus to the waist of the wearer.

5. Apparatus as described in claim 4, wherein the front section of said apparatus is constructed of a material less elastic than the material of said buttocks separating means.

6. Apparatus as described in claim 1, wherein said buttocks lifting means comprises two pairs of opposed straps attached securely at one end to said buttocks separating means and adjustably fastened at the other end to the front section of said apparatus.

7. Apparatus as described in claim 6, wherein the first of said pairs of opposed straps is positioned along the fold of the buttocks extending from said buttocks separating means to the front section of said apparatus.

8. Apparatus as described in claim 7, wherein the second of said pairs of opposed straps is positioned above and substantially parallel to said first pair of straps extending from said buttocks separating means around the fullest portion of the buttocks to the front section of said apparatus.

9. Apparatus as described in claim 1, wherein said buttocks lifting means comprises a pair of heavy elastic panels conforming to the shape of the buttocks from the waist to the fold of the buttocks, said panels being secured along the center back thereof to said buttocks separating means and adjustably fastened along the sides thereof to the front section of said apparatus.

10. A garment which allows the wearer unconsciously to exercise the muscles of the buttocks and the pelvic floor in an isometric manner, said garment comprising:

(a) a back section including a central, longitudinal strip extending along the center of the wearer's lower back from the waist, between the sections of the buttocks and the legs to the front of said garment, said back section further including a pair of opposed panels secured along one end to said central longitudinal strip and adjustably fastened along the opposite end to the front of said garment; and (b) a front section including a crotch portion to which said central longitudinal strip is attached and further including right and left side portions with adjustable fasteners attached thereto for adjustably securing said opposed panels to said front section.

11. A garment as described in claim 10, wherein said central longitudinal strip is constructed of a non-elastic material, said pair of opposed panels is constructed of an elastic material, and said front section is constructed of a nonelastic material.

12. A garment which allows the wearer unconsciously to exercise the muscles of the buttocks and pelvic floor in an isometric manner, said garment comprising:

(a) a back section including a central longitudinal strip extending along the center of the wearer's lower back from the waist, between the sections of the buttocks and the legs to the front of said garment, said back section further including two pairs of opposed straps, the first of said pair of straps extending across each section of the buttocks at the folds thereof and the second of said pair of straps extending across each section of the buttocks at the fullest part thereof and substantially parallel to said first pair of straps;

(b) a front section including a crotch portion to which said central longitudinal strip is attached and further including right and left side portions with adjustable fasteners attached thereto for adjustably securing said pairs of straps to said front section; and (c) a waistband extending around the top of said garment and conforming to the shape of the wearer's waist to which is attached said central longitudinal strip and said front section.

* * * * *